US005774556A

United States Patent [19]

Lowe et al.

[11] Patent Number: 5,774,556

[45] Date of Patent: Jun. 30, 1998

[54] STEREO ENHANCEMENT SYSTEM INCLUDING SOUND LOCALIZATION FILTERS

[75] Inventors: Danny D. Lowe; Scott Willing; William Gonnason; Mark Williams; Don Lafont, all of Calgary, Canada

[73] Assignee: QSound Labs, Inc., Alberta, Canada

[21] Appl. No.: 511,788

[22] Filed: Aug. 7, 1995

Related U.S. Application Data

[63] Continuation-in-part of Ser. No. 115,577, Sep. 3, 1993, Pat. No. 5,440,638.

[51] Int. Cl.[6] ..... H04S 5/00

[52] U.S. Cl. ..... 381/17

[58] Field of Search ..... 381/1, 17

[56] References Cited

U.S. PATENT DOCUMENTS

| | | | |
|---|---|---|---|
| 4,308,424 | 12/1981 | Bice, Jr. | 179/1 |
| 4,355,203 | 10/1982 | Cohen | 381/1 |
| 5,026,051 | 6/1991 | Lowe et al. | 273/435 |
| 5,046,097 | 9/1991 | Lowe et al. | 381/17 |
| 5,052,685 | 10/1991 | Lowe et al. | 273/460 |
| 5,095,507 | 3/1992 | Lowe | 381/17 |
| 5,105,462 | 4/1992 | Lowe et al. | 381/17 |
| 5,138,660 | 8/1992 | Lowe et al. | 381/17 |
| 5,412,731 | 5/1995 | Desper | 381/1 |
| 5,440,638 | 8/1995 | Lowe et al. | 381/17 |

FOREIGN PATENT DOCUMENTS

| | | | |
|---|---|---|---|
| U9211335 | 12/1992 | WIPO | H04S 3/00 |
| U9312688 | 12/1992 | WIPO | H04S 3/00 |

OTHER PUBLICATIONS

Budak, Passive and Active Network Analysis and Synthesis, 1974, pp. 395–397.

*Primary Examiner*—Forester W. Isen
*Attorney, Agent, or Firm*—Fulbright & Jaworski L.L.P

[57] ABSTRACT

The sound field in a stereo reproduction system is enhanced by a preprocessor that removes a portion of the audio information that is common or substantially common to both the left and right stereo input signals before processing the signals in left and right sound placement filters. The left and right placement filter output signals, from which a portion of the common audio information was previously removed before processing, are added to the right and left stereo input signals, respectively, to produce enhanced sound field stereo output signals. The input signals that do not undergo placement processing can be delayed in delay filters to improve coherency when the signals are added and both the placement filters and the delay filters can be implemented by a series of cascaded bi-quadratic filters.

4 Claims, 4 Drawing Sheets

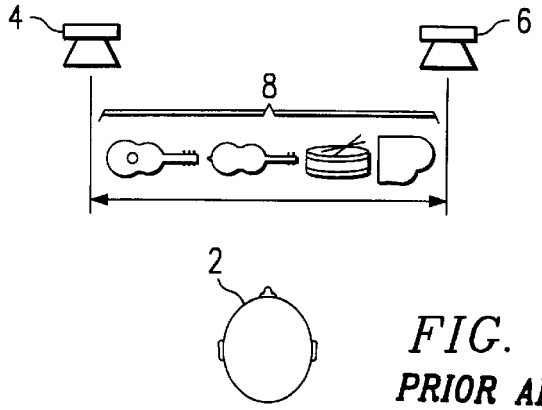
FIG. 1
PRIOR ART
FIG. 2
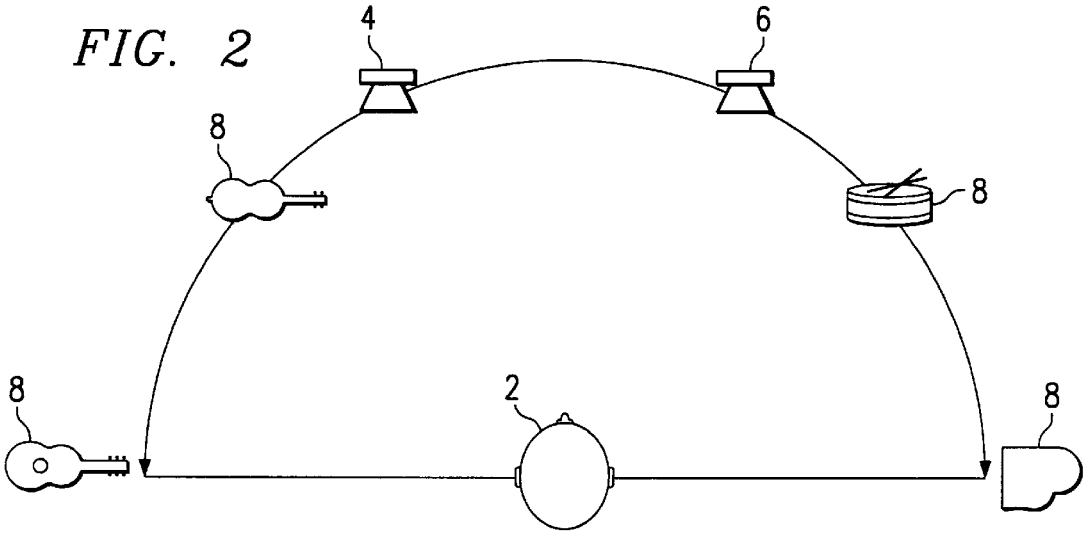
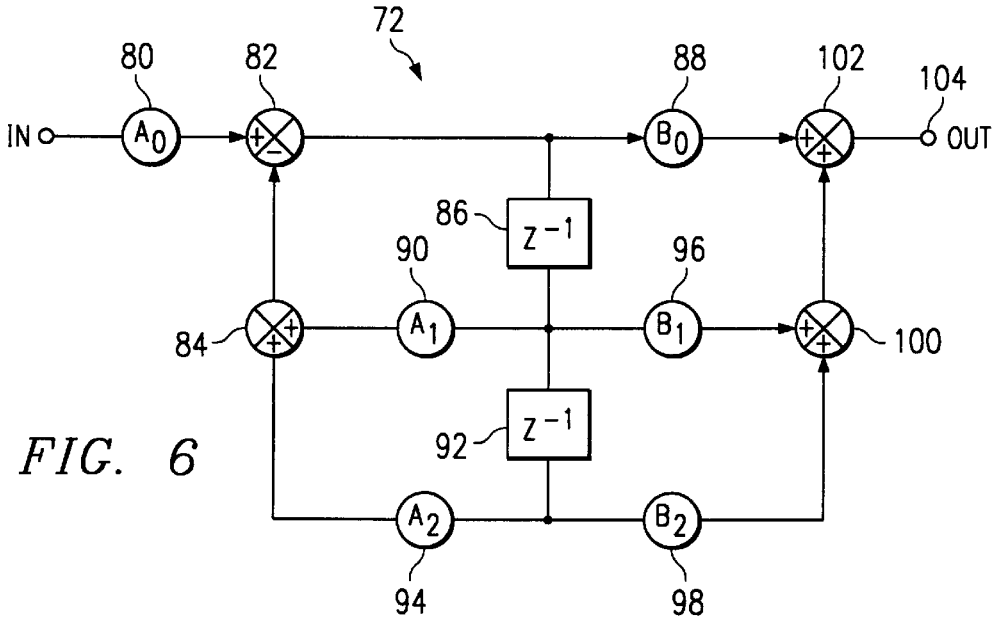
FIG. 6

STEREO ENHANCEMENT SYSTEM INCLUDING SOUND LOCALIZATION FILTERS

This is a continuation in part of application Ser. No.08/115,577, filed Sep. 3, 1993, now U.S. Pat. No. 5,440,638.

BACKGROUND OF THE INVENTION

1. Field of the Invention

This invention relates generally to a method and apparatus for enhancing the effects of a stereophonic audio reproduction system and, more particularly, to a method and apparatus for processing stereo signals to enhance the sound field provided in stereo reproduction.

2. Description of the Background

There are now well known numerous systems that are intended to process stereophonic signals during playback in an effort to improve the stereophonic effects that are available. For example, some systems are intended to improve the stereo separation or to place the apparent source of the sounds at locations other than the actual location of the loudspeaker. One system for stereo processing would apply the left channel signal to a specialized left-placement filter and then apply the right channel signal to a right-placement filter. The left input signal and the output of the right-placement filter would be added to form the left signal and the right input channel would be added to the output of the left-placement filter to form the right channel. Such a system can provide some improved stereo effects over a conventional stereo playback system.

On the other hand, normal stereo program material has information that is common to both channels. Thus, in an unprocessed stereo playback system using two loudspeakers this common program information would appear in the center of the stereophonic sound field. It is this common information, or information that is substantially the same in both channels, that when processed according to a system such as described above will result in a general lack of information in and at the center of the sound field. This is so because such common audio information is being simultaneously processed in both the left-placement filter and in the right-placement filter. Thus, the sounds are generally diminished relative to that common material and the present inventors have found that due to such cancellation there is a decrease in the low-frequency information in the processed or so-called enhanced stereo output signals.

OBJECTS AND SUMMARY OF THE INVENTION

Accordingly, it is an object of the present invention to provide a method and apparatus for enhancing the sound field of stereo playback signals that can eliminate the above-noted defects inherent in the previously proposed systems.

Another object of this invention is to provide a method and apparatus for stereo enhancement in which the common information in stereophonic signals is not processed in sound placement filters, so as to provide a more even and expansive stereophonic sound field.

A further object of the present invention is to provide a method and apparatus for stereophonic enhancement in which a pre-processor is provided to prevent a portion of the common information of the left and right stereo signals from being processed or filtered and which adjusts amplitudes and time delays in the left and right channels so that an enhanced stereophonic sound field is provided.

According to an aspect of the present invention, a preprocessor is provided for insertion between a signal source, such as the audio pre-amplifier output stage of a stereo system and the final power amplifier stage. In such preprocessor, all or just a portion of the common information is deleted or subtracted from the signal before being processed in sound placement filters for left and right placement. The outputs from the placement filters are then combined with the respective input signals to produce the left and right stereo output signals having enhanced stereo effects.

The above and other objects, features, and advantages of the present invention will become apparent from the following detailed description of illustrative embodiments thereof to be read in conjunction with the accompanying drawings, in which like reference numerals represent the same or similar elements.

BRIEF DESCRIPTION OF THE DRAWINGS

FIG. 1 is a pictorial representation showing conventional stereo sound imaging;

FIG. 2 is a pictorial representation showing enhanced stereo imaging provided by an embodiment of the present invention;

FIG. 6 is a block diagram showing a second order biquadratic placement filter stage according to an embodiment of the present invention;

DETAILED DESCRIPTION OF PREFERRED EMBODIMENTS

According to an embodiment of the present invention a front-end preprocessor is provided to a system typically employing left and right placement filters, which preprocessor prevents common information and so-called mono-signals from being processed. Thus, the placement filters operate solely on the true stereo signals and the common program material passes through the system unfiltered. Because various signals in a stereo program are frequently placed neither at the right or left channel and are frequently completely monaural or consisting of entirely common material, the effect of the present invention will be to spread the unprocessed stereo signals proportionately across a wider stereophonic sound field.

FIG. 1 represents a typical stereo sound field or sound image, in which a listener 2 who is positioned in front of two loudspeakers 4 and 6 perceives the musical instruments, shown generally at 8, to be spread across a sound stage extending between the left and right loudspeakers 4 and 6. While this sound field of FIG. 1 can be generally acceptable, the present invention seeks to enhance the stereo image and broaden the sound stage.

FIG. 2 represents an enhanced stereo image that is much more enjoyable to the listener 2, as well as being more realistic. In this enhanced stereo sound field the instruments 8 can appear at locations beyond the physical locations of the loudspeakers 4 and 6. That is, the sound stage extends not only beyond the actual locations of the loudspeakers from side to side but, also, an added depth perception is provided so that the actual placement of the various instruments on the stage, for example, can be discerned by the listener 2.

Figure 3:
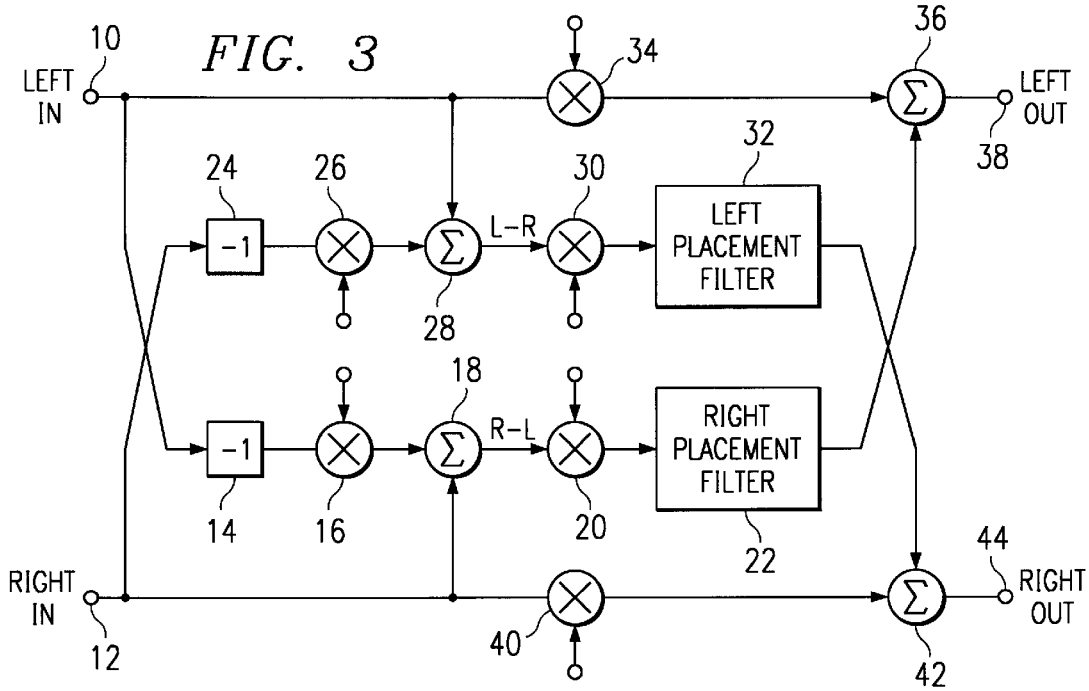
FIG. 3 is a schematic in block diagram form of a stereo enhancement system according to an embodiment of the present invention.

A system to accomplish this sound field widening or enhancement is shown in FIG. 3. Conventional left and right stereo signals, which are at the line level such as nominally one volt as might be produced by a pre-amplifier section to the main power amplifier section, are fed in at input terminals 10 and 12, respectively. In this system, it will be appreciated that the signal fed to the respective left and right side placement filters is a true stereo signal or difference signal that has a portion of the common information removed. More specifically, the stereo left channel signal fed at in input terminal 10 is passed through an inverter 14 and fed to a controllable attenuator 16. The output of attenuator 16 is fed to one input of a signal summing circuit 18. The other input to signal summing circuit 18 is the right channel signal fed in at terminal 12. Therefore, because the left channel is inverted and fed to the summing circuit 18, the output of summing circuit 18 is effectively the difference between the right and left channels. This signal is fed through a controllable attenuator 20 whose output is then fed to the right placement filter 22. Similarly, the right channel signal fed in at terminal 12 is passed through an invertor 24 to a controllable attenuator 26. The output of the attenuator comprises one input to a signal summing circuit 28 with the other input consisting of the left channel signal fed in at input 10. The output then of the signal summing circuit 28 represents the left channel signal with the right channel subtracted therefrom. That difference signal is fed through a controllable attenuator 30 whose output then is the input to the left-placement filter 32. The left-channel signal fed in at terminal 10 can be level adjusted in controllable attenuator 34 and the output fed to one input of a signal summing circuit 36. The other input of signal summer 36 is the output of the right-placement filter 22, so that the output of summer 36 becomes the stereo enhanced left channel output signal available at terminal 38. Similarly, the right channel signal fed in at input 12 is passed through a controllable attenuator 40 whose output becomes one input to a signal summing circuit 42. The other input to the signal summer 42 is the output of the left-placement filter 32. The output of the signal summer 42 is available at terminal 44 and represents the stereo enhanced right channel signal.

It will be appreciated initially from the embodiment of FIG. 3 that, since the two channels are effectively subtracted from each other before being fed to the respective placement filter, if the signals are equal no placement filtering takes place at all and the original signals are fed to the respective left and right output terminals 38 and 44.

In the embodiment of FIG. 3, the attenuators 16, 20, 26, 30, 34, and 40 are so-called controllable attenuators. These attenuators all have a control input so that the extent of their attenuation can readily be controlled. Such control may consist of an initial setting in which the input to the attenuators would be represented by a constant K, or the control can be a continuous and on-going variable and may be controlled by a microprocessor or the like to achieve various degrees of stereo enhancement.

Figure 4:
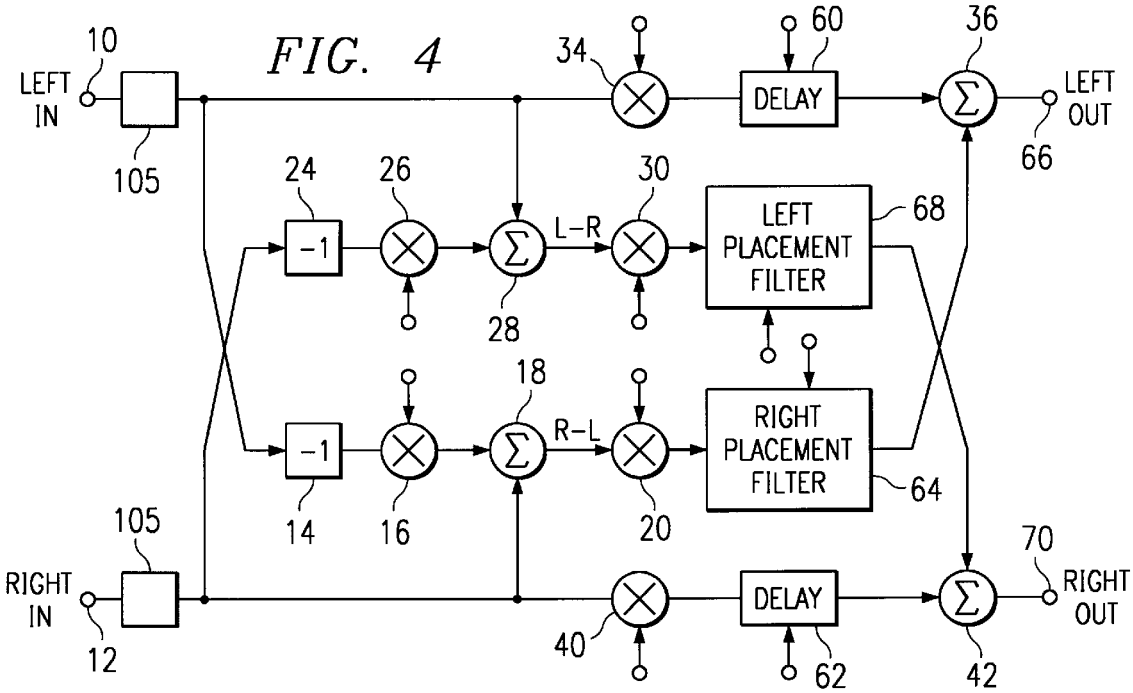
FIG. 4 is a schematic in block diagram form showing the system of FIG. 3 with added delay filters.

In the embodiment of FIG. 3 all of the attenuators, invertors, and the like, as well as the left and right placement filters require a finite length of time to perform their various functions. Therefore, in order to have the entire system be correctly timed, delay units in the left and right channels can be provided. Specifically, as shown in FIG. 4 the output of the attenuator 34 is fed to a controllable delay unit 60 and the output of the variable attenuator 40, which represents the right channel, is fed to another controllable delay unit 62. The extent of the delay to be imparted can be either preset, in which case the control terminals to the delay units would have a constant fed in or it can be controllable such as by a microprocessor or the like to achieve various different stereo effects. In each event, however, the output of delay unit 60 is fed as one input to the signal summing circuit 36 and the other input to signal summer 36 is the output of the right-placement filter 64. This right-placement filter 64 can also be a controllable filter, in which either the control input is a constant, in which case the filter effect is fixed, or the control input can be a variable as controlled by a microprocessor or some other programmed source. In each event, the output of the right-placement filter 64 becomes the second input to the signal summer 36 whose output then is the left-channel output appearing at terminal 66. Similarly, the output of the controllable delay 62 is fed as one input to signal summer 42 whose other input is derived from the controllable left-placement filter 68. That filter may be controlled by either a constant or variable value. The output of signal summer 42, is fed out as the right-channel output on terminal 70.

By providing controllable left and right placement filters 68 and 64, this means that the transfer function of the overall filter can b e controlled. Such control may be user selectable, for example, to optimize the stereo enhancer for different speaker geometries or to adjust the center of the image focusing to the optimum listening position.

Although in the embodiments of FIGS. 3 and 4 all of the left and right placement filterin g is shown as taking place in respective left and right placement filters, it should be understood that the filtering operations can be distributed between both signal paths for each left and right channel. The placement filtering operation provides a phase and amplitude differential between the signal paths of a channel. That differential need not be achieved using only a single placement filter in one signal path. A filter in each signal path of a channel could also be advantageously employed. Thus, in the embodiment of FIG. 4 the controllable delay filters 60 and 62 could be replaced by complementary placement filters.

Figure 5:
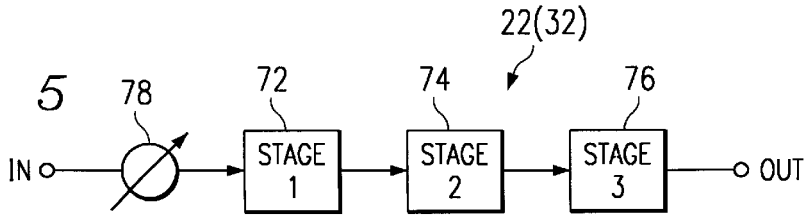
FIG. 5 is a schematic in block diagram form of an embodiment of the sound placement filter of the present invention using three filter stages.

FIG. 5 is a schematic representation of an embodiment of the right placement filter 22 or left placement filter 32 of FIG. 3. Although a three-stage filter is shown, this filter could also be embodied by any number of stages. Also, although an IIR filter is shown in FIG. 6, other kinds of filters could also be advantageously used. Similarly, the filter shown in FIG. 5 could also be used as the right placement filter 64 and/or the left placement filter 68 of the embodiment of FIG. 4. Although the filters are identified as left and right filters, in fact, the same filter can be used for both the left and right channels. It has been found that using different filter configuration for the two channels results in undesirable artifacts being created. In constructing this filter, three stages, stage 1, 72, stage 2, 74 and stage 3, 76 are connected in series or cascade. Each of the stages then is seen as being a single stage filter, which will be shown in detail in FIG. 6. At the input of the cascade single stage filters 72, 74, 76, is a scale multiplier 78 used to adjust the signal level in view of the continuation of the filters.

Turning to FIG. 6, the actual filter construction of one of the stages in FIG. 5 is shown in detail.

This filter is a digital representation of a filter having poles and zeros. The input signal is initially passed through a multiplier 80 for multiplying the signal in accordance with the first pole value of 1.0 in this example. The multiplied signal is then fed to an adder 82 that has connected to its negative input a signal from a second adder 84. The output of adder 82 is fed to a one sample delay unit 86 and also to another multiplier 88. Multiplier 88 is represented as having coefficient $B_0$ which is the first order zero factor and, in this case, is represented by the multiplication value 1.0. The output of the first delay unit 86 is fed to another multiplier 90 having the coefficient $A_1$ which is the second order pole and in this embodiment has a value of −1.64451184525604. The delayed input signal from the first delay unit 86 is also fed to a second delay unit 92 that provides a one-sample delay. The output of the second delay unit 92 is fed to another multiplier 94 representing the third order pole value which in this case is 0.73799030853044. The output of the second order multiplier 90 and third order multiplier 94 are fed to the adder 84 whose output is then subtracted from the input signal in adder 82.

The output of the first delay unit 86 is fed to a second order zero multiplier 96 whose coefficient value is represented as 0.0. Similarly, the output of the second delay unit 92 is fed to the third order zero multiplier 98 having the multiplication coefficient 0.0. The output of the second order zero multiplier 96 and the third order zero multiplier 98 are fed to an adder 100 with the sum signal fed to one input of an output adder 102. The other input to adder 102 is from the first order zero multiplier 88 and the filter output then appears at terminal 104.

As shown in FIG. 5, the placement filter such as 72 is only one of three such filters connected in cascade. All of the filters are second-order biquadratic filters, as shown in FIG. 6, however, the coefficient values for the multipliers that determine the poles and zeros may not necessarily be the same for each stage of the filter. For example, in stage 2 the first order multiplier for determining the poles, the coefficient would be 1.0 and in the second order multiplier, the coefficient would be −0.99807001285503 and the third order multiplier coefficient would be 0.61059291835028. On the other hand, the multiplier coefficients for determining the zeros representing multipliers $B_0$, $B_1$, and $B_2$ in the second stage 74, the coefficients might be 1.0, 0.0, and 0.0, respectively.

In regard to the third stage 76 shown in FIG. 5, the first, second, and third order multiplier coefficients as represented by multipliers $A_0$, $A_1$, $A_2$ would be 1.0, −.6107968716533 and 0.811801, respectively. The coefficients for the multiplier determining the zero points in the filter of the stage three for the three respective multipliers might be 1.0, 0.0, and 0.1, respectively.

It will be understood that the above coefficient values are presented by way of example only and that other values can be used so long as the filters perform to the required efficiency.

The overall transfer function for the filter shown in FIG. 6, for example, might be given by the following expression:

$$H_k = \prod_{k=1}^{n} \frac{B0_k + B1_k(Z)^{-1} + B2_k(Z)^{-2}}{A0_k + A1_k(Z)^{-1} + A2_k(Z)^{-2}}$$

Figure 7A:
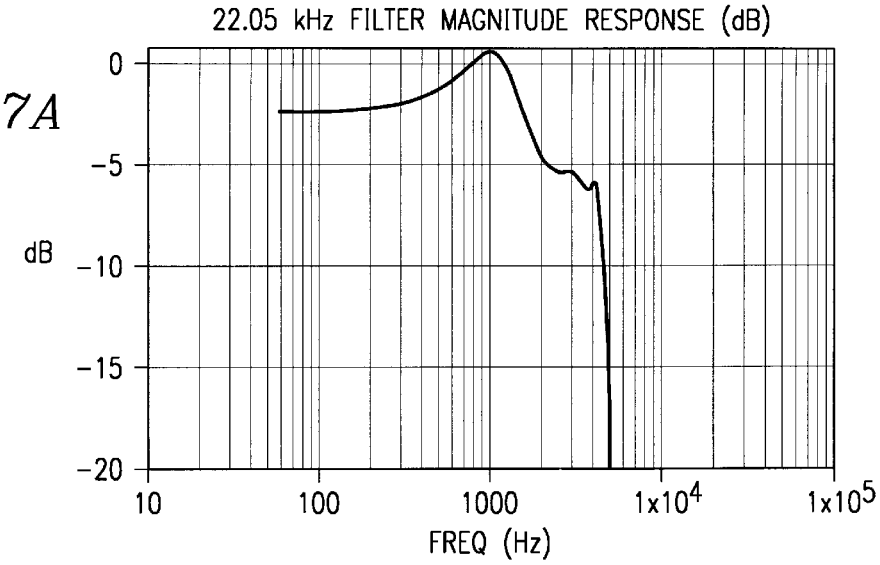
FIGS. 7A and 7B are typical transfer function curves for the filter shown in FIG. 5 at a sample rate of 22.05 kHz.
Figure 7B:
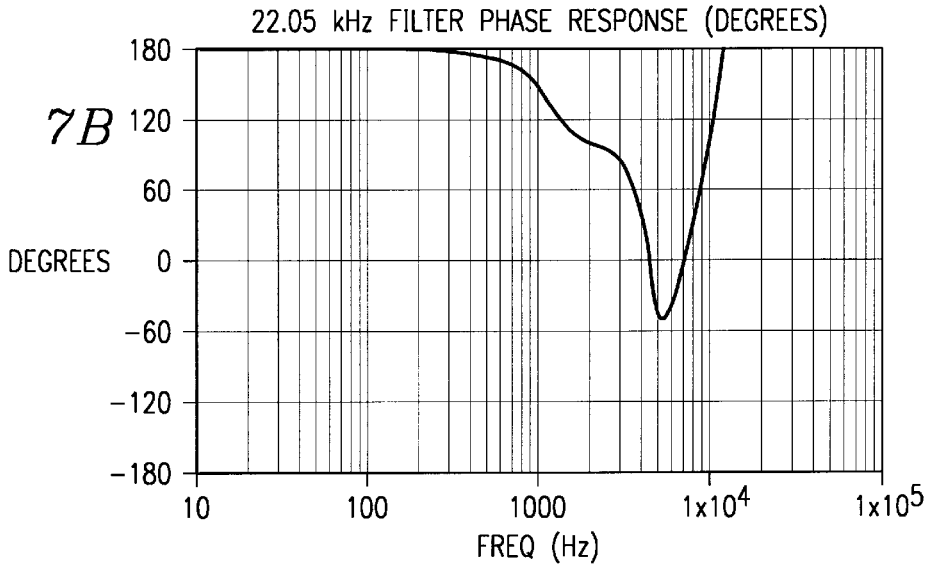
Figure 8A:
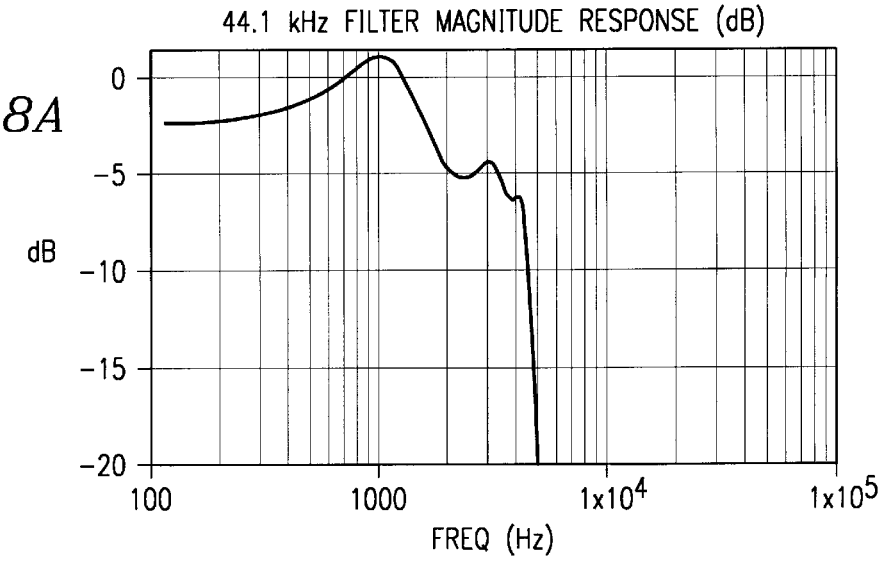
FIGS. 8A and 8B are typical transfer function curves for the filter shown in FIG. 5 at a sample rate of 44.1 kHz.
Figure 8B:
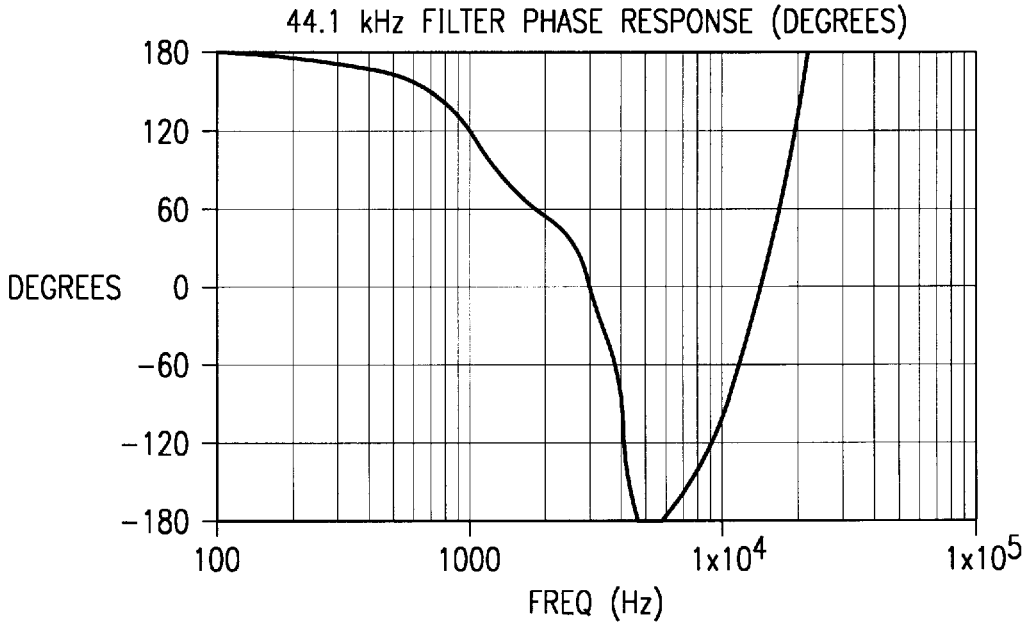

In the filter shown for example in FIG. 6, the sampling rate may be selected from at least two different sample rates, for example, 22.05 kHz or 44.1 kHz. The FIGS. 7A and 7B represent the filter magnitude response and filter phase response, respectively, for a sample rate of 22.05 kHz. On the other hand, FIGS. 8A and 8B represent the filter magnitude response and filter phase response for a filter sample rate of 44.01 kHz.

Figure 9:
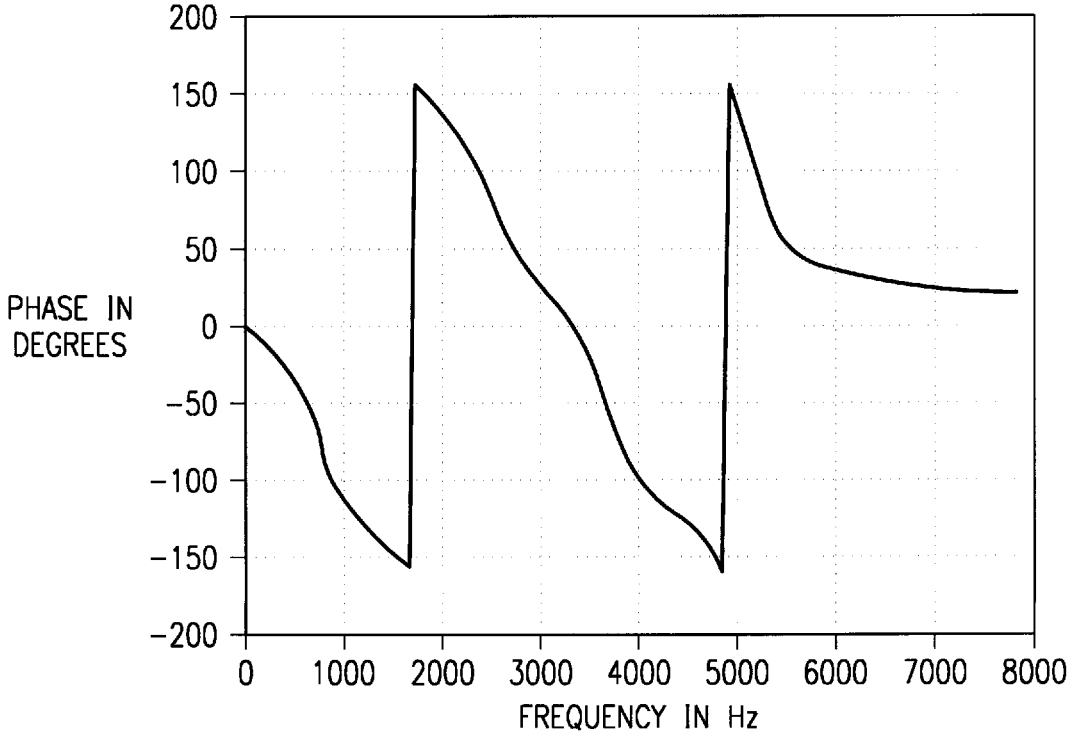
FIG. 9 is a typical phase delay function of the delay filters used in the system of FIG. 5.

FIG. 9 represents a typical left filter delay function plotted as phase delay versus frequency as might be present in the left delay filter stage 60. The right delay filter stage 62 would have a phase versus frequency response along the same lines but not necessarily identical to that shown in FIG. 9.

It has been determined by the inventors that utilizing such a filter network results in some loss of low frequency energy from the original source material. In order to restore the lower frequency energy a portion of the opposite channel signal can be subtracted from the input to the phase and amplitude placement filters and this has been shown in listening tests to effectively restore some of the low frequency energy without adversely affecting image quality.

On the other hand, another approach for front end processing consists of bass boost filters, which can be applied to each signal before it is processed by the filter circuitry. Another approach that can be implemented with the bass boost filters is to provide semilogarithmic dynamic range compression for the signals prior to being fed to the filters. Such dynamic range compression would reduce the amplitude of the peak values and increase the amplitude of the lower values in the source material to provide a lower overall dynamic range in the output signals. The inventors have conducted listening tests that indicate that the compressed signal material should be readily acceptable to a wider audience than noncompressed signal material and may reduce offensiveness of source material amplitude variations. Furthermore, the equalization and compression filters can be individually controllable by the user of the apparatus or by a programmed control system to adjust the various equalization values and the extent of compression.

The above description is based on preferred embodiments of the present invention, however, it will apparent that modifications and variations thereof could be effected by one with skill in the art without departing from the spirit or scope of the invention, which is to be determined by the following claims.

What is claimed is:

1. Stereo sound field enhancement apparatus receiving left-channel and right-channel audio signals, comprising:

means for receiving the left-channel and right-channel audio signals and for producing a left output signal from which a portion of audio information common to the right-channel audio signal is absent and for producing a right output signal from which a portion of audio information common to the left-channel audio signal is absent;

a right placement filter receiving said right output signal and producing a left audio image processed signal, said right placement filter including three cascaded filter units having identical structure and having different respective pole and zero coefficients;

a left placement filter receiving said left output signal and producing a right audio image processed signal, said left placement filter including three cascaded filter units having identical structure and having different respective pole and zero coefficients;

means for receiving the right-channel audio signal and producing a delayed right-channel signal;

means for receiving the left-channel audio signal and producing a delayed left-channel signal; and means for combining said left audio image processed signal and said delayed left-channel signal to produce a left-channel output signal and for combining said right audio image processed signal and said delayed right-channel signal to produce a right-channel output signal.

2. A stereo sound field enhancement apparatus according to claim 1, further comprising:

first and second controllable attenuators for attenuating the left-channel and right-channel audio signals before being fed to said means for combining said left output signal and said right output signal.

3. A stereo sound field enhancement apparatus according to claim 1, wherein said right-placement filter and said left-placement filter each comprise a cascaded series of second order bi-quadratic filters.

4. A stereo sound field enhancement apparatus according to claim 1, wherein said means for producing the delayed left channel signal and said means for producing the delayed right channel signal each comprise a cascaded series of bi-quadratic filters.

* * * * *